US007088298B1

(12) United States Patent
Chan

(10) Patent No.: US 7,088,298 B1
(45) Date of Patent: Aug. 8, 2006

(54) ANTENNA SYSTEM

(75) Inventor: Yiu Kwong Chan, Vernon Hills, IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 11/117,032

(22) Filed: Apr. 28, 2005

(51) Int. Cl.
*H01Q 21/00* (2006.01)

(52) U.S. Cl. ..... 343/727; 343/730; 343/767; 343/795

(58) Field of Classification Search ..... 343/725, 343/727, 729, 730, 700 MS, 767, 795
See application file for complete search history.

(56) References Cited

U.S. PATENT DOCUMENTS

| | | | | |
|---|---|---|---|---|
| 6,424,309 | B1 * | 7/2002 | Johnston et al. | 343/767 |
| 6,882,322 | B1 * | 4/2005 | Apostolos et al. | 343/767 |
| 6,900,770 | B1 * | 5/2005 | Apostolos | 343/725 |
| 2006/0055612 | A1 * | 3/2006 | Kim et al. | 343/767 |

* cited by examiner

*Primary Examiner*—Hoanganh Le
(74) *Attorney, Agent, or Firm*—Randi L. Karpinia; Douglas S. Rupert

(57) ABSTRACT

An antenna system (100) comprising a first electromagnetic radiator (102) and a second electromagnetic radiator (104) is provided. The first electromagnetic radiator incorporates an off-center series feed (112) at a pre-defined distance from a first end (114) of the antenna system. The second electromagnetic radiator incorporates a shunt feed (120) at a second pre-defined distance from a second end (122) of the antenna system. The first electromagnetic radiator is used primarily for plural band transmission-reception and the second electromagnetic radiator for antenna diversity band reception.

25 Claims, 11 Drawing Sheets

ANTENNA SYSTEM

FIELD OF THE INVENTION

This invention relates in general to wireless communication devices, and more specifically to an antenna system associated with a wireless communication device.

BACKGROUND OF THE INVENTION

Wireless communication devices have developed over the years in the wake of evolving technology. Earlier, wireless communication devices operated in the Analog Mobile Phone System (AMPS) protocol, and later graduated to the Global System for Mobile Communication (GSM) protocol. The need for increased capacity, higher data speeds, and new service capabilities in wireless communication devices have resulted in the evolution of GSM-based Second Generation (2G/2.5G) architecture into Third Generation (3G) architecture. 3G architecture uses Universal Mobile Telecommunication Systems (UMTS) as communication protocol. 3G architecture/UMTS enables service operators to provide broader services, while supporting a larger number of clients.

Existing wireless communication devices such as cellular telephones, laptops, digital computers and messaging devices can operate at different frequency bands to cater to the frequency requirements of different geographical locations. The wireless communication devices can operate in combination as well. Wireless communication devices can provide multiple services such as satellite, radio and television signal communication. It is desirable for wireless communication devices to be capable of accommodating different transmit and receive frequencies, in order to operate at different frequency bands. In addition, there is a demand for diversity reception for UMTS signals.

This may create a requirement for the wireless communication devices to possess an antenna system having a main radiator, and one or more co-located secondary radiators for transmitting signals and receiving signals.

A wireless communication device may have a plurality of antenna systems. For instance, a first antenna system may be a local antenna system, which is permanently integrated with the existing wireless communication devices, while a second antenna system may be connected to the wireless communication device by conduction through transmission cable. The first antenna system may suffer from the limitation of digital noise interference while operating with the wireless communication device At such instances, transmission is switched over to the second antenna system. The second antenna system may be a remote antenna system acting as an alternative solution to the local antenna system in a weak signal range, or when digital noise emitted by the wireless communication device is increased to a level close to the desired signal level by the local antenna system. The second antenna system may be connected with the wireless communication device either through interconnecting signal cable. The second antenna system may also act as a peripheral that plugs into the wireless communication device.

To each of the local and remote antenna system, the presence of two separate radiators within the antenna system can lead to interference in the signals between the two radiators. General arrangement of the radiators may not allow proper isolation of signals between the radiators. Lack of proper isolation between the signals introduces disturbances to signals conveyed by the radiators. Further, hardware requirements for isolating the signals may increase the device cost.

In addition, wireless communication devices graduating to 3G architecture require that the second radiator is attached separately to satisfy inter-radiator isolation or the diversity correlation. Attaching the second radiator separately entails complex operations and also affects the working of the wireless communication devices.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
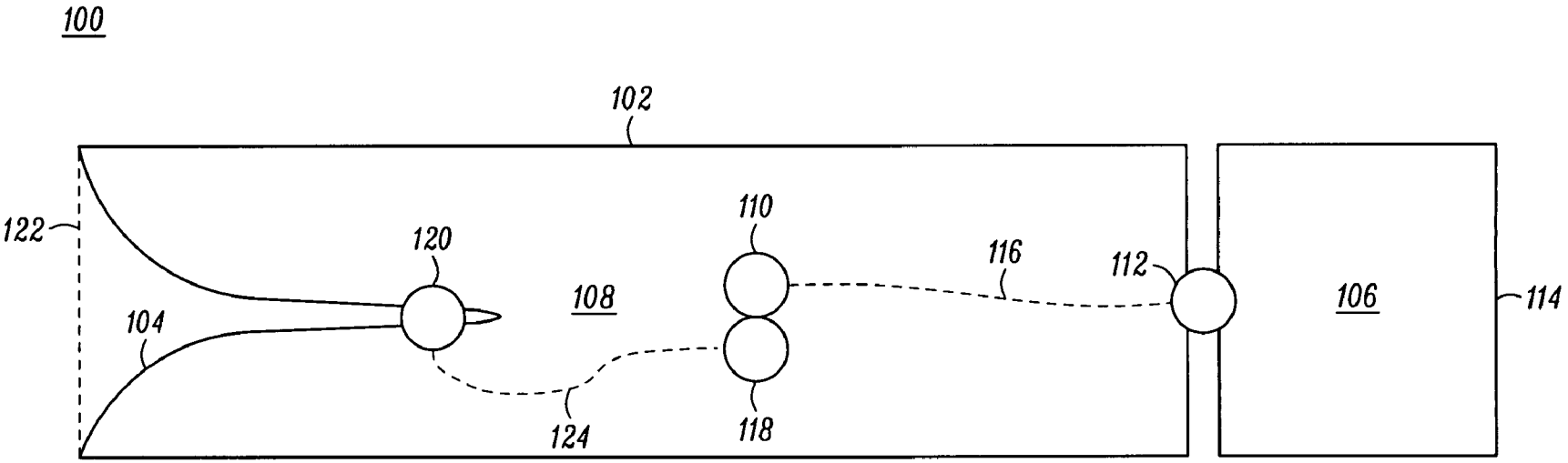
FIG. 1 illustrates an example of an antenna system, in accordance with one embodiment of the present invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

In an embodiment of the present invention, an antenna system comprising a first electromagnetic radiator and a second electromagnetic radiator is disclosed. The first electromagnetic radiator incorporates an off-center series feed at a pre-defined distance from a first end of the antenna system. The first electromagnetic radiator further incorporates a first pole and a second pole. The first pole is on a first side of the off-center series feed, and the second pole is on an opposing side of the off-center series feed. The second electromagnetic radiator incorporates a shunt feed at a second predefined distance from bottom of a notch which is either shaped in a V-notch, a U-notch, a Y-notch or any symmetric geometry of metal construction on axis (or plane) of symmetry, such that axis (or plane) is concentric to the dipole conductor axis (or plane).

Before describing in detail the particular antenna system in accordance with the present invention, it should be observed that the present invention resides primarily in apparatus components related to an antenna system. Accordingly, the apparatus components have been represented where appropriate by conventional symbols in the drawings, showing only those specific details that are pertinent to understanding the present invention so as not to obscure the disclosure with details that will be readily apparent to those of ordinary skill in the art having the benefit of the description herein.

In this document, relational terms such as first and second, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element. Since passive antenna is generally equally effective in reception as it is in radiation, of balanced reciprocity, in the text although not explicitly stated, that the word radiation implies including reception.

The term "another", as used in this document, is defined as at least a second or more. The terms "including" and/or "having", as used herein, are defined as comprising.

FIG. 1 illustrates an antenna system 100, in accordance with an exemplary embodiment of the present invention. The antenna system 100 is used for transmitting and receiving signals, hereinafter referred to as band transmission and band reception in wireless communication devices. The wireless communication devices include, but are not limited to, cellular telephones, laptop computers, Personal Digital Assistants (PDAs), messaging devices, and the like. The antenna system 100 can be used for band transmission and band reception for a plurality of protocols, such as Advanced Mobile Phone Systems (AMPS), Global System for Mobile Communications (GSM), Digital Cellular Systems (DCS), Personal Communication Systems (PCS), and Universal Mobile Telecommunication Systems (UMTS).

The antenna system 100 includes a first electromagnetic radiator 102 and a second electromagnetic radiator 104. The first electromagnetic radiator 102 can be used for band transmission and the second electromagnetic radiator 104 for band reception. However, it will be apparent to one skilled in the art that the first electromagnetic radiator 102 can also be used for band reception and the second electromagnetic radiator 104 for band transmission. In an embodiment of the present invention, the first electromagnetic radiator 102 covers a first diversity signal for UMTS, while the second electromagnetic radiator 104 covers the second diversity signal for UMTS.

In addition, the second electromagnetic radiator 104 acts as an alternative solution to the first electromagnetic radiator 102 in a weak signal range, or when digital noise emitted by the corresponding wireless communication device is increased to a level close to the desired signal level. The second electromagnetic radiator 104 maintains wireless communication with much lower digital noise, reducing digital noise interference of the first electromagnetic radiator 102. Similarly, the first electromagnetic radiator 104 may act as an alternative solution to the second electromagnetic radiator 102 in a weak signal range, or when digital noise emitted by the corresponding wireless communication device is increased to a level close to the desired signal level.

In an embodiment of the present invention, the first electromagnetic radiator 102 is a dipole antenna. The first electromagnetic radiator 102 includes a first pole 106, a second pole 108, a first transmission port 110, and an off-center series feed 112.

In an embodiment of the present invention, the first electromagnetic radiator 102 is a metallic structure immersed in space and the second electromagnetic radiator 104 is a hollow structure carved out of, or integrated to the second pole 108 of the first electromagnetic radiator 102.

In an embodiment of the present invention, the first pole 106 is shorter than the second pole 108. Further, the electrical size of the sum of the first and second poles 106 and 108 correlates closely to two-quarters of a first surface wave-specific wavelength of the antenna system 100, wherein the first surface wave-specific wavelength is a ratio of a first surface wave speed and a first pre-determined frequency of the antenna system 100.

In another embodiment of the present invention, the first pole 106 is shorter than the second pole 108. Further, the electrical size of the first pole 106 correlates closely to one-quarter of a second surface wave-specific wavelength of the antenna system 100. The second surface wave-specific wavelength is a ratio of a second surface wave speed and a second pre-determined frequency of the antenna system 100.

In addition, the electrical size of the second pole 108 can be influenced by the electrical size of the second electromagnetic radiator 104. The electrical size of the second electromagnetic radiator 104 correlates to one-quarter of a third surface wave-specific wavelength. The third surface wave-specific wavelength is a ratio of a third surface wave speed and a third pre-determined frequency.

The first transmission port 110 is a conduction port that carries signals for the first electromagnetic radiator 102. The first transmission port 110 transmits the signals to the off-center series feed 112, which is at a first pre-defined distance from a first end 114 of the antenna system 100. The first pre-defined distance of the off-center series feed 112 depends on factors, including a frequency of operation and impedance of the first electromagnetic radiator 102. In addition, the off-center series feed 112 is at a pre-defined position on the first electromagnetic radiator 102 at the first pre-defined distance. For example, the off-center series feed 112 is at the center of an intervening slot at the first pre-defined distance. The centric positioning of the off-center series feed 112 on an intervening gap should yield optimal signal isolation between 102 and 104. However, the pre-defined position of the off-center series feed 112 is not limited to anywhere within the width of the first electromagnetic radiator 102. The pre-defined position of the off-center series feed 112 can be extended beyond the edges of the first electromagnetic radiator 102 by adding one or more non-radiating or radiating transmission sections.

The first transmission port 110 and the off-center series feed 112 are connected through a transmission line 116. In an embodiment of the present invention, the transmission line 116 can be a strip-line or a micro-strip line.

The second electromagnetic radiator 104 is carved out of the second pole 108 of the first electromagnetic radiator 102. The second electromagnetic radiator 104 is either shaped in a V-notch, a U-notch, a Y-notch or any symmetric geometry of metal construction on axis (or plane) of symmetry, such that axis (or plane) is concentric to the dipole conductor axis (or plane). The second electromagnetic radiator 104 includes a second transmission port 118 and a shunt feed 120. The second transmission port 118 is a conduction port that carries signals for the second electromagnetic radiator 104. The second transmission port 118 receives signals from the shunt feed 120, which is at a second pre-defined distance from a second end 122 of the antenna system 100. The second pre-defined distance depends on factors, including a frequency of operation and impedance of the second electromagnetic radiator 104. The shunt feed of the second radiator described is a preferred feed method, however, is not limited to that. With the surface standing wave or field by the second radiator with respect to same by the first radiator remains orthogonal to each other, any feed method may be use in favor to optimal conducted power transfer.

The second transmission port 118 and the shunt feed 120 are connected through a transmission line 124. In an embodiment of the present invention, the transmission line 124 can be a strip-line or a micro-strip line.

Figure 2:
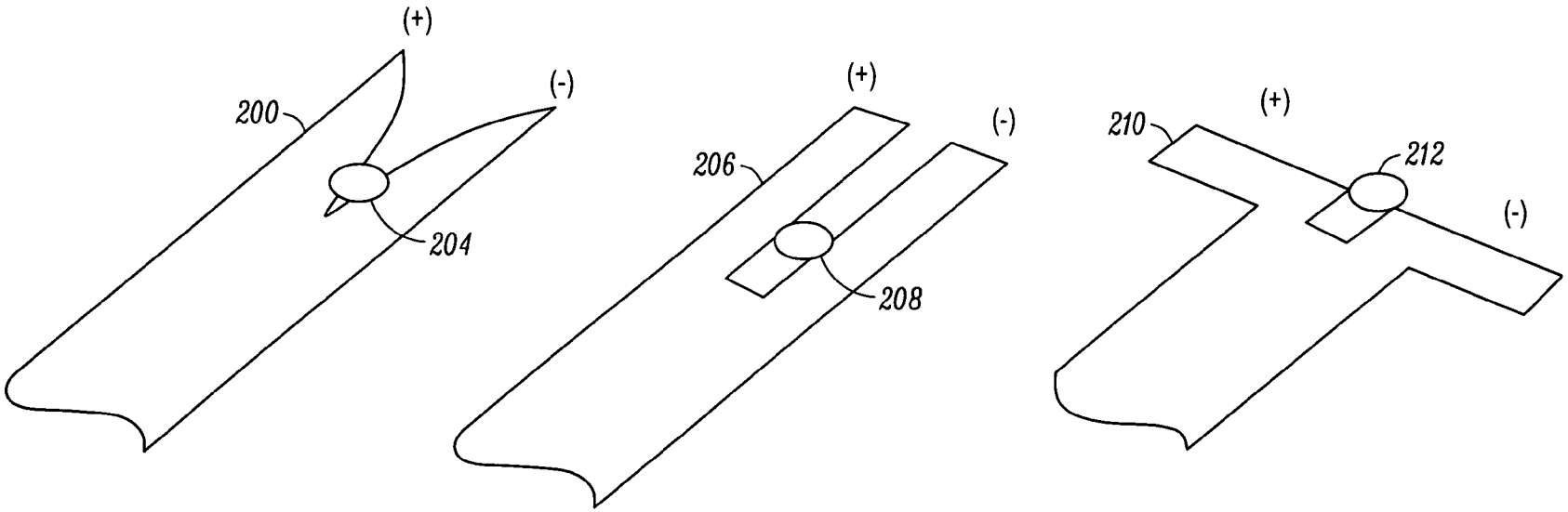
FIG. 2 illustrates an example of an electromagnetic radiator, in accordance with some embodiments of the present invention.

FIG. 2 shows various embodiments of an electromagnetic radiator, in accordance with various exemplary embodiments of the present invention. The electromagnetic radiator is similar to the second electromagnetic radiator 104. In an embodiment of the present invention, the second electromagnetic radiator 104 is a V-notch antenna 200 with a shunt feed 204. In another embodiment of the present invention, the second electromagnetic radiator 104 is a U-shaped antenna 206 with a shunt feed 208. In yet another embodiment of the present invention, the second electromagnetic radiator 104 is a slit antenna 210 with a shunt feed 212.

Figure 3:
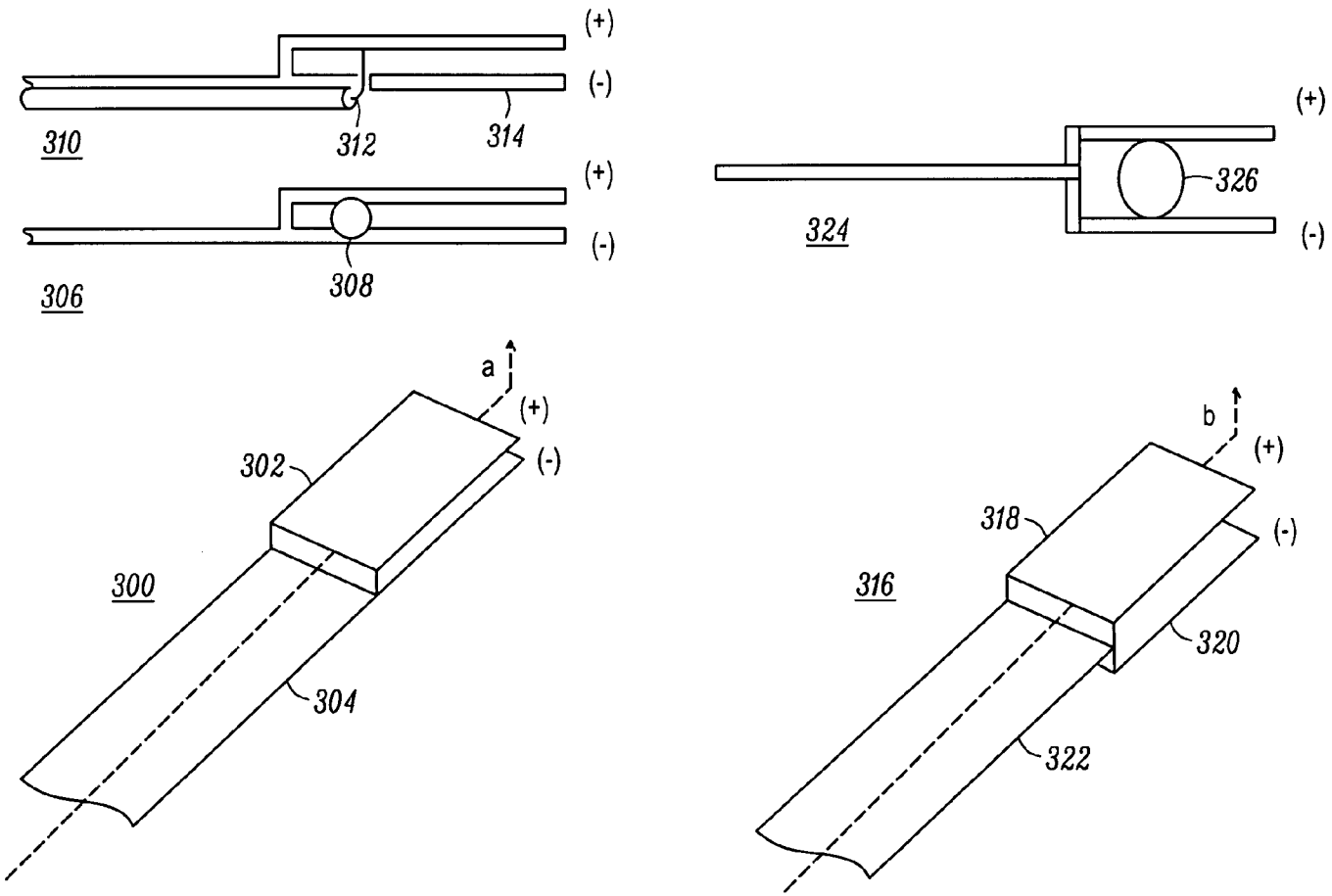
FIG. 3 illustrates various examples of the electromagnetic radiator, in accordance with some embodiments of the present invention.

FIG. 3 shows various embodiments of the second electromagnetic radiator 104, in accordance with various exemplary embodiments of the present invention. In an embodiment of the present invention, the second electromagnetic radiator 104 is either a Y-shaped metallic structure 300, or a Y-shaped metallic structure 316. The Y-shaped metallic structure 300 incorporates the second electromagnetic radiator 104 as a plate 302 attached to a base plate 304. Y-shaped metallic structure 306 is a cross-sectional view of the Y-shaped metallic structure 300 through cut line a. Y-shaped metallic structure 306 incorporates a shunt feed 308, which is similar to the shunt feed 120. Y-shaped metallic structure 310 is yet another embodiment of the second electromagnetic radiator 104, wherein a shunt feed 312 passes through an aperture in a base plate 314. Similarly, the Y-shaped metallic structure 316 incorporates the second electromagnetic radiator 104 as a first plate 318 and a second plate 320 attached to a base plate 322. Y-shaped metallic structure 324 is a cross-sectional view of the Y-shaped metallic structure 316 through cut line b, incorporating a shunt feed 326.

Figure 4:
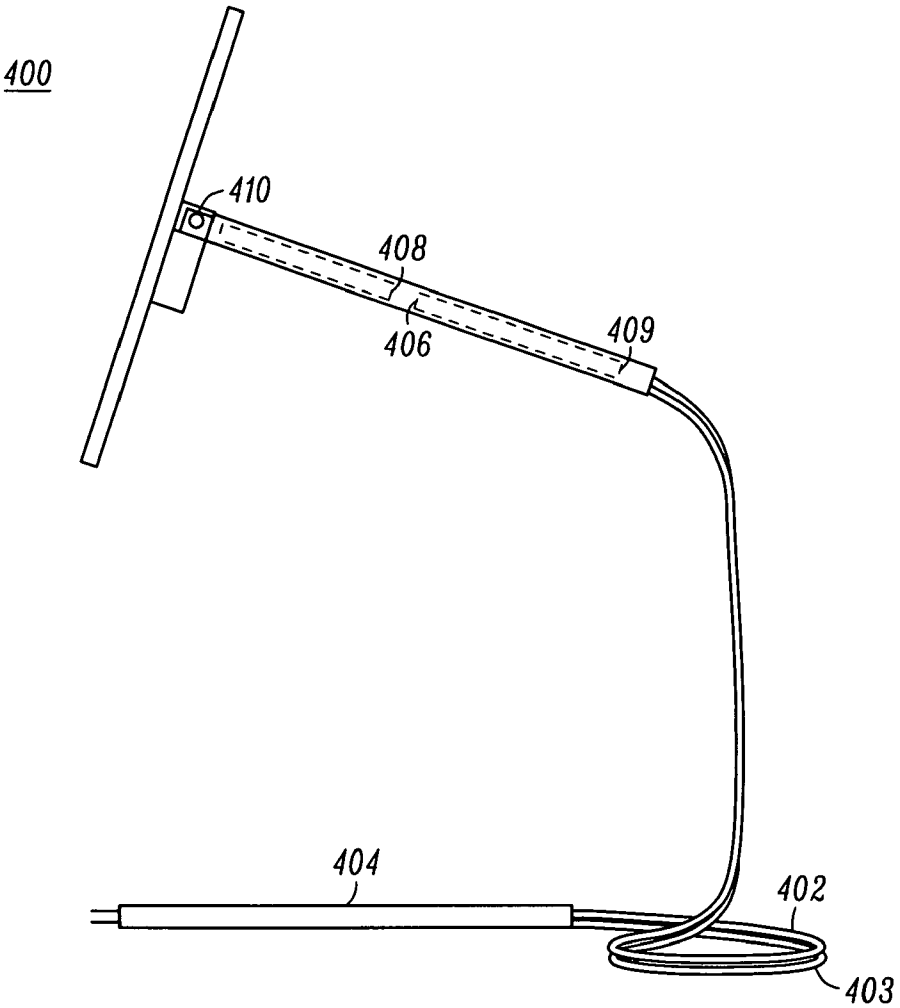
FIG. 4 illustrates an example of a side view of the antenna system, in accordance with one embodiment of the present invention.

FIG. 4 shows a side view of an antenna system 400, in accordance with another embodiment of the present invention. The antenna system 400 is similar to the antenna system 100, and includes a transmission line 402, a transmission line 403, a Carbon Fibre (CF)-braided sleeve 404, a hinged sleeve 406, a balun 408 and a balun 409. The transmission line 402 and the transmission line 403 are used for carrying signals and providing independent conduction paths for the first electromagnetic radiator 102 and the second electromagnetic radiator 104. In an embodiment of the present invention, the transmission lines 402 and 403 are coaxial cables. The transmission line 402 and 403 are enveloped in the CF-braided sleeve 404 of pre-defined length, which absorbs noise coming from the wireless communication devices.

The hinged sleeve 406 connects the transmission line 402 to the first transmission port 110, and the transmission line 403 to the second transmission port 118. The hinged sleeve 406 is capable of rotating at a pre-defined angle around an antenna end 410. In an embodiment of the present invention, the pre-defined angle is ninety (90) degrees. One or more baluns are present in the hinged sleeve 406. The baluns isolate the transmission lines 402 and 403 from the transmission ports 110 and 118. Isolation of the transmission lines 402 and 403 from the transmission ports 110 and 118 helps in avoiding radiation pattern distortion in the antenna system 100. In addition, the baluns also helps in reducing noise in the antenna system 100. In an embodiment of the present invention, the balun 408 and the balun 409 are present in the hinged sleeve 406.

Figure 5:
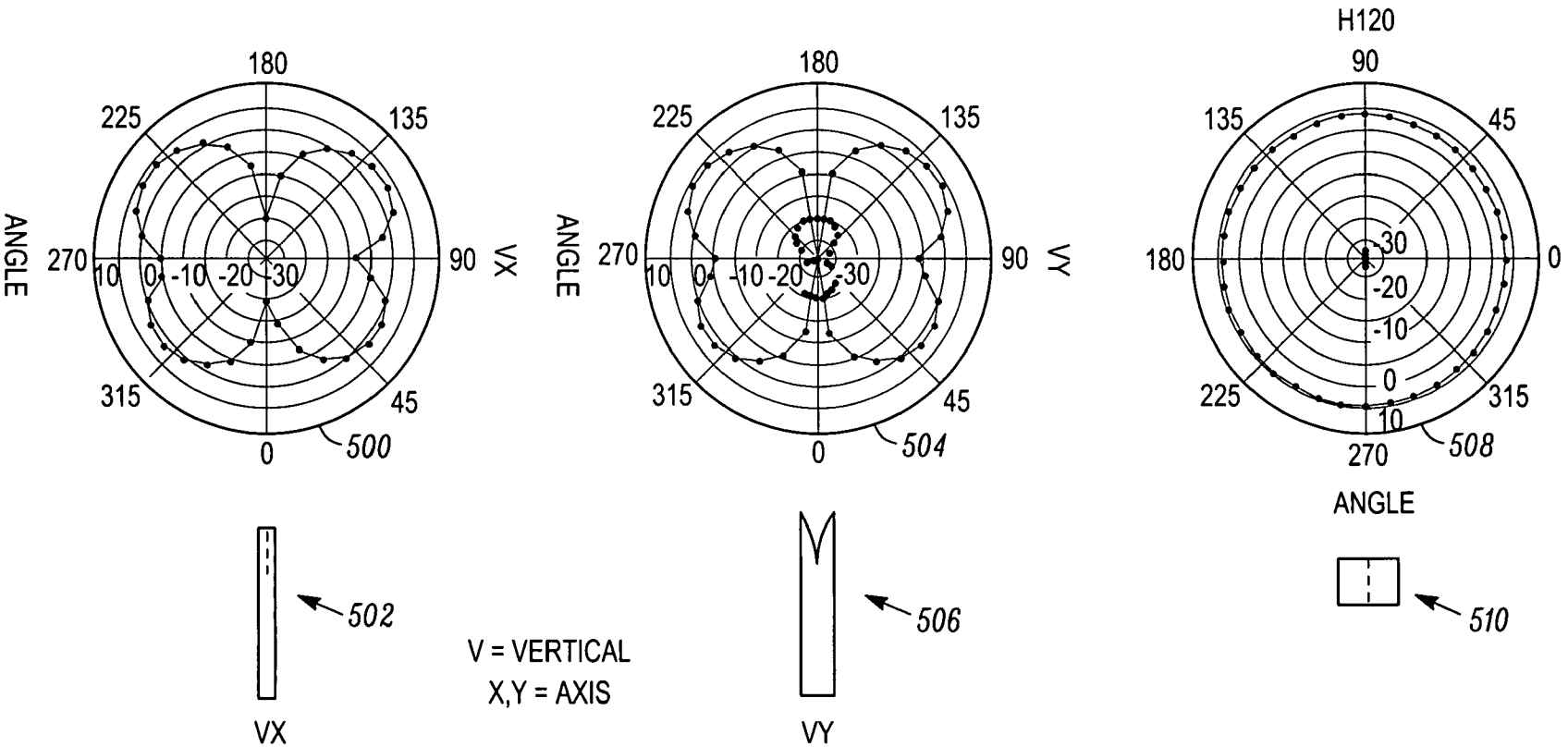
FIG. 5 illustrates an example of the radiation patterns of an electromagnetic radiator in various orientations, in accordance with some embodiments of the present invention.

FIG. 5 shows the radiation patterns of the first electromagnetic radiator 102 in various orientations, for UMTS protocol, in accordance with an exemplary embodiment of the present invention. A radiation pattern 500 corresponds to an orientation 502 of the first electromagnetic radiator 102. Similarly, a radiation pattern 504 corresponds to an orientation 506, and another radiation pattern 508 corresponds to yet another orientation 510 of the first electromagnetic radiator 102.

Figure 6:
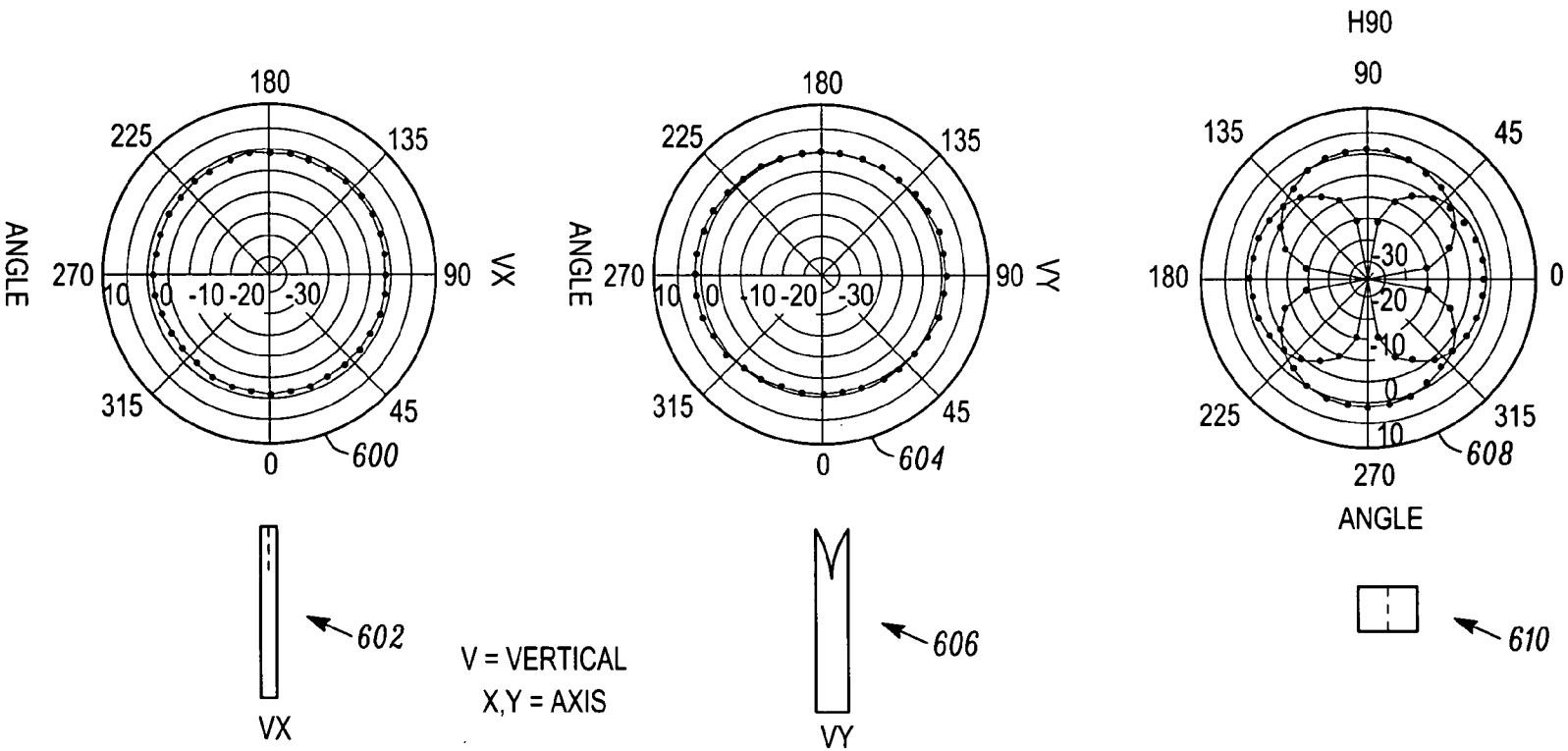
FIG. 6 illustrates an example of the radiation patterns of another electromagnetic radiator, in various orientations, in accordance with some embodiments of the present invention.

FIG. 6 shows the radiation patterns of the second electromagnetic radiator 104 in various orientations, for UMTS protocol, in accordance with an exemplary embodiment of the present invention. A radiation pattern 600 corresponds to an orientation 602 of the second electromagnetic radiator 104. Similarly, a radiation pattern 604 corresponds to an orientation 606, and another radiation pattern 608 corresponds to yet another orientation 610 of the second electromagnetic radiator 104.

Figure 7:
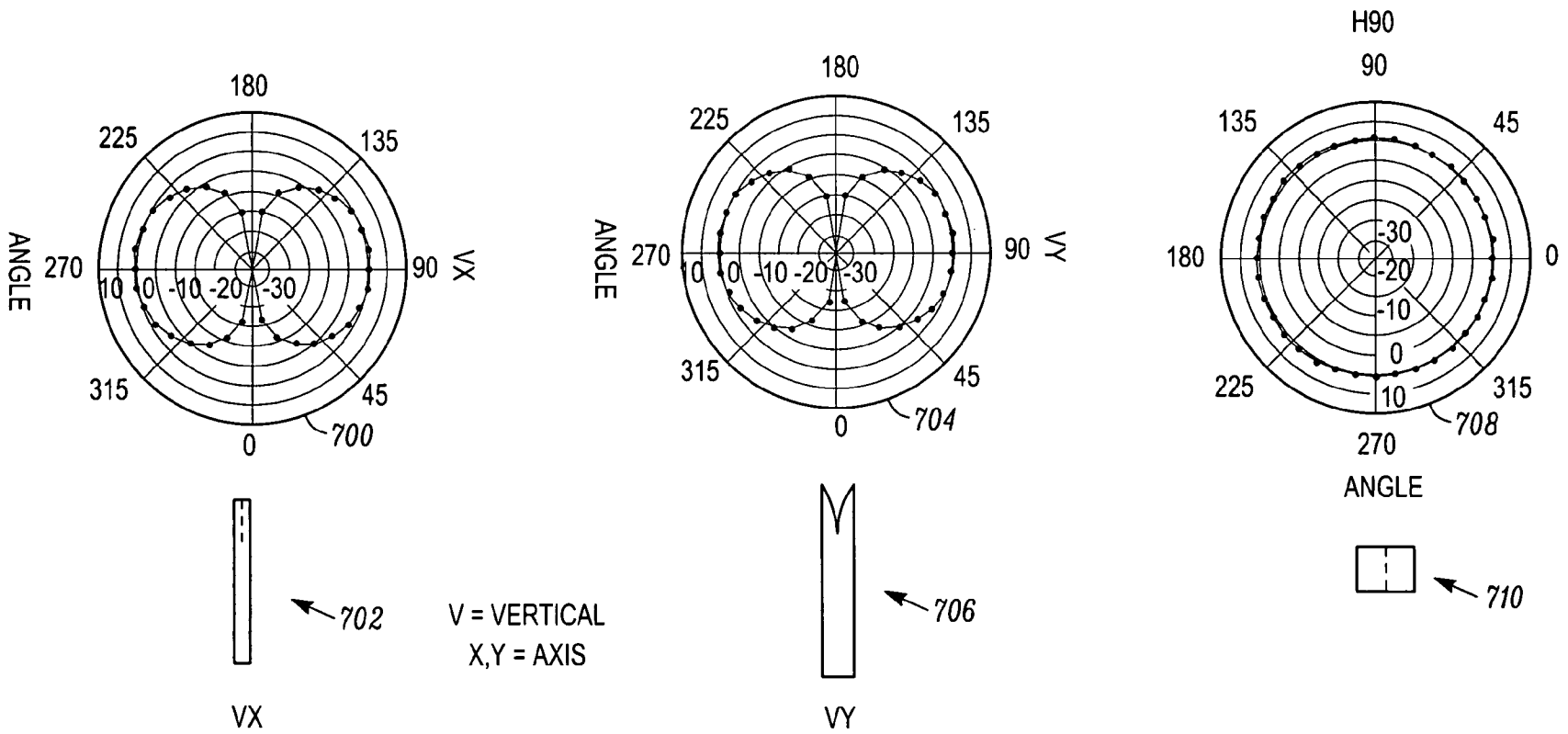
FIG. 7, FIG. 8, FIG. 9, and FIG. 10 illustrate examples of the radiation patterns of the electromagnetic radiator illustrated in FIG. 5 in various orientations, in accordance with some embodiments of the present invention.

FIG. 7 shows the radiation patterns of the first electromagnetic radiator 102 in various orientations, for AMPS protocol, in accordance with an exemplary embodiment of the present invention. A radiation pattern 700 corresponds to an orientation 702 of the first electromagnetic radiator 102. Similarly, a radiation pattern 704 corresponds to an orientation 706, and another radiation pattern 708 corresponds to yet another orientation 710 of the first electromagnetic radiator 102.

Figure 8:
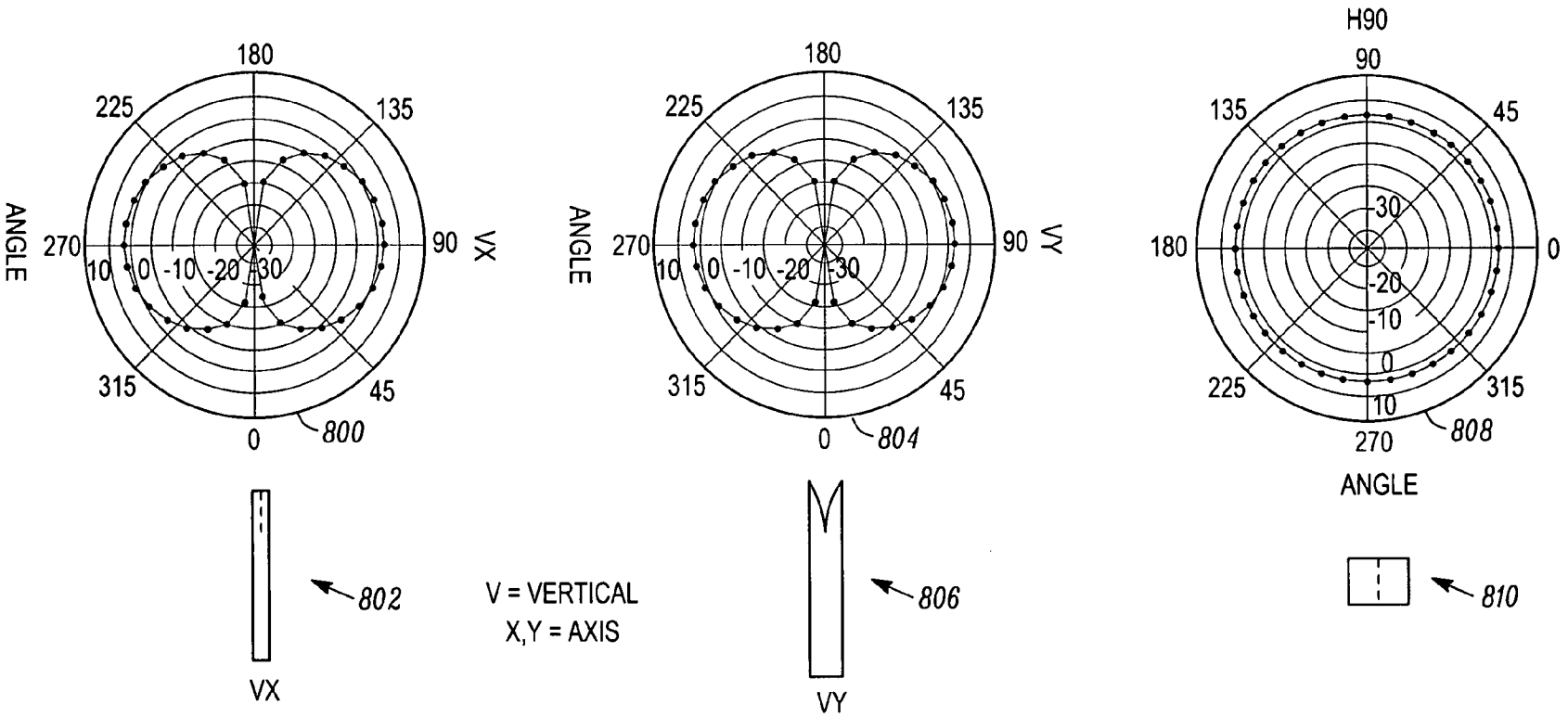

FIG. 8 shows the radiation patterns of the first electromagnetic radiator 102 in various orientations, for GSM protocol, in accordance with another exemplary embodiment of the present invention. A radiation pattern 800 corresponds to an orientation 802 of the first electromagnetic radiator 102. Similarly, a radiation pattern 804 corresponds to an orientation 806, and another radiation pattern 808 corresponds to yet another orientation 810 of the first electromagnetic radiator 102.

Figure 9:
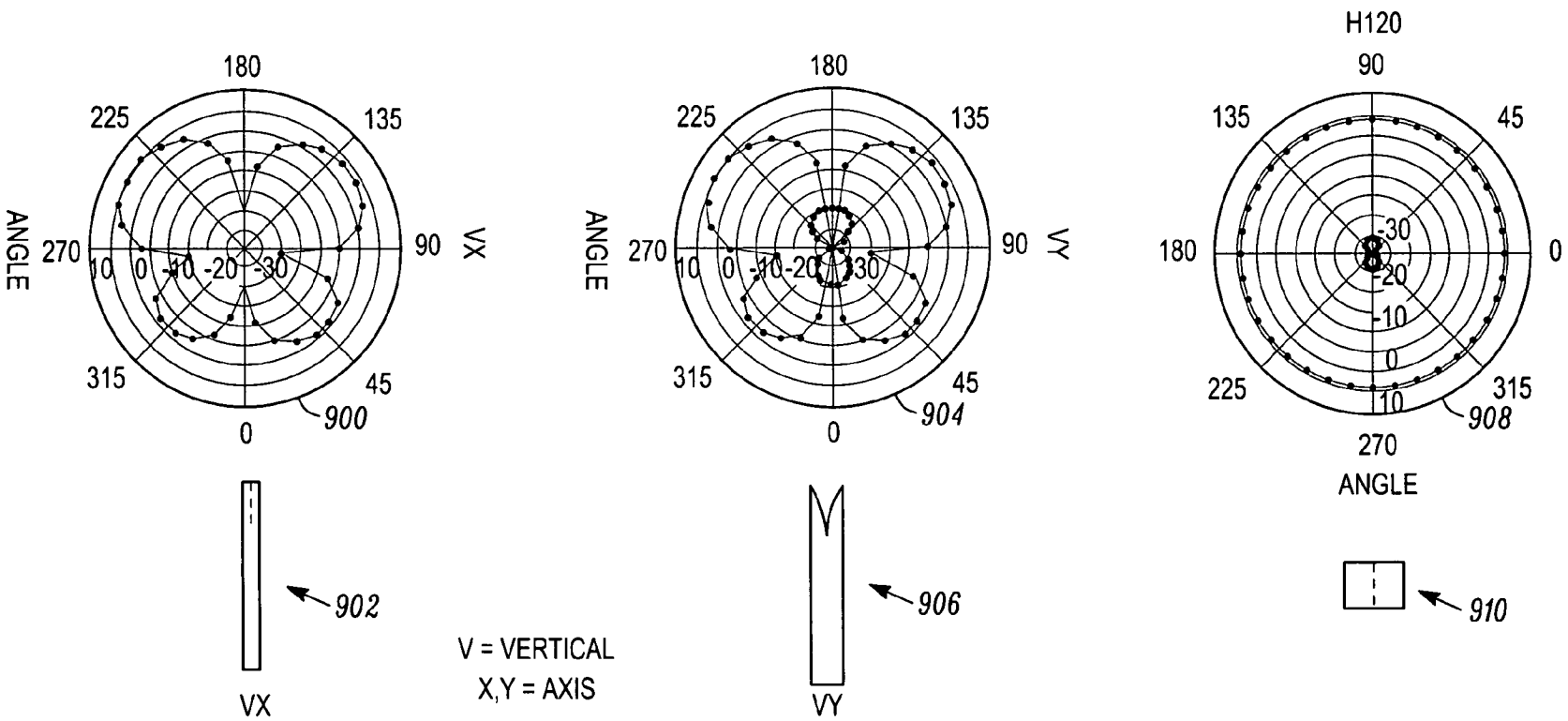

FIG. 9 shows the radiation patterns of the first electromagnetic radiator 102 in various orientations, for DCS protocol, in accordance with yet another exemplary embodiment of the present invention. A radiation pattern 900 corresponds to an orientation 902 of the first electromagnetic radiator 102. Similarly, a radiation pattern 904 corresponds to an orientation 906, and another radiation pattern 908 corresponds to yet another orientation 910 of the first electromagnetic radiator 102.

Figure 10:
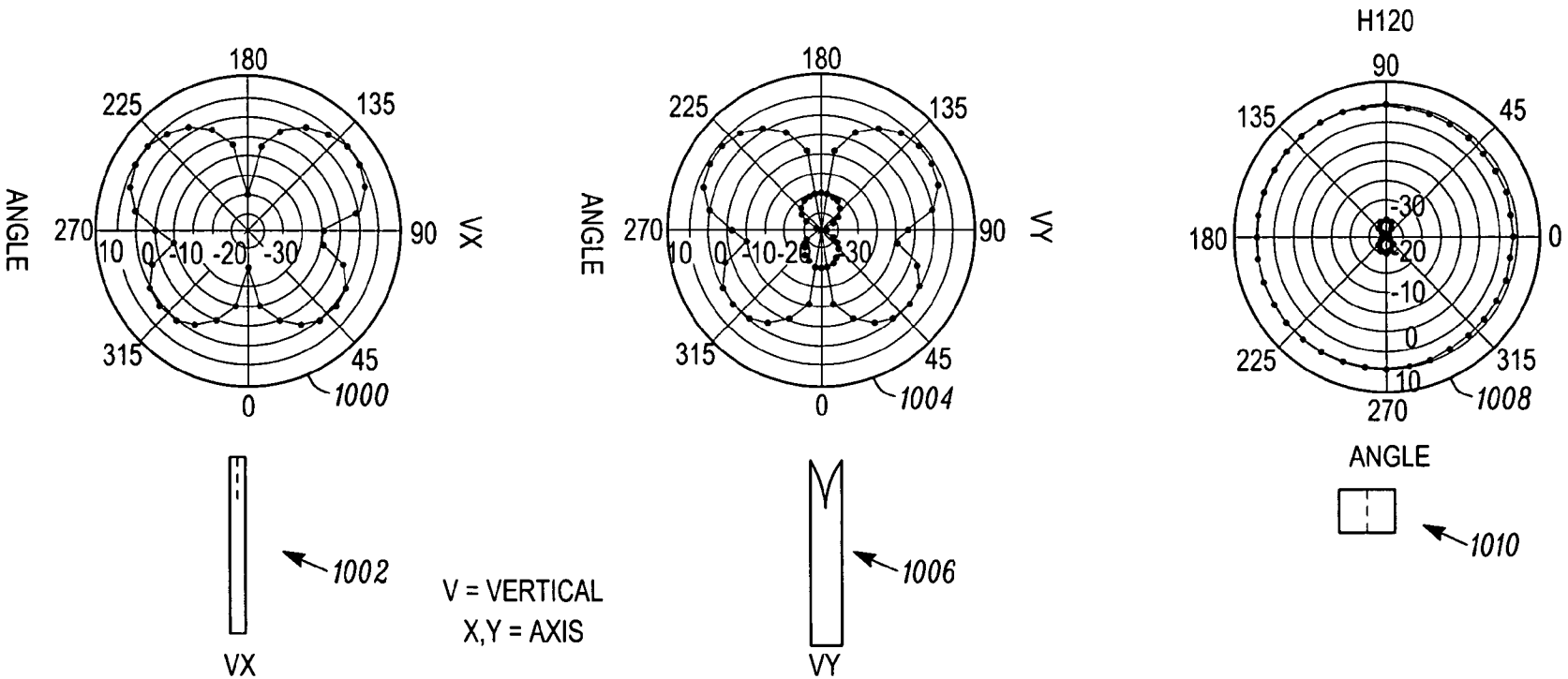

FIG. 10 shows the radiation patterns of the first electromagnetic radiator 102 in various orientations, for PCS protocol, in accordance with another exemplary embodiment of the present invention. A radiation pattern 1000 corresponds to an orientation 1002 of the first electromagnetic radiator 102. Similarly, a radiation pattern 1004 corresponds to an orientation 1006, and another radiation pattern 1008 corresponds to yet another orientation 1010 of the first electromagnetic radiator 102.

Figure 11:
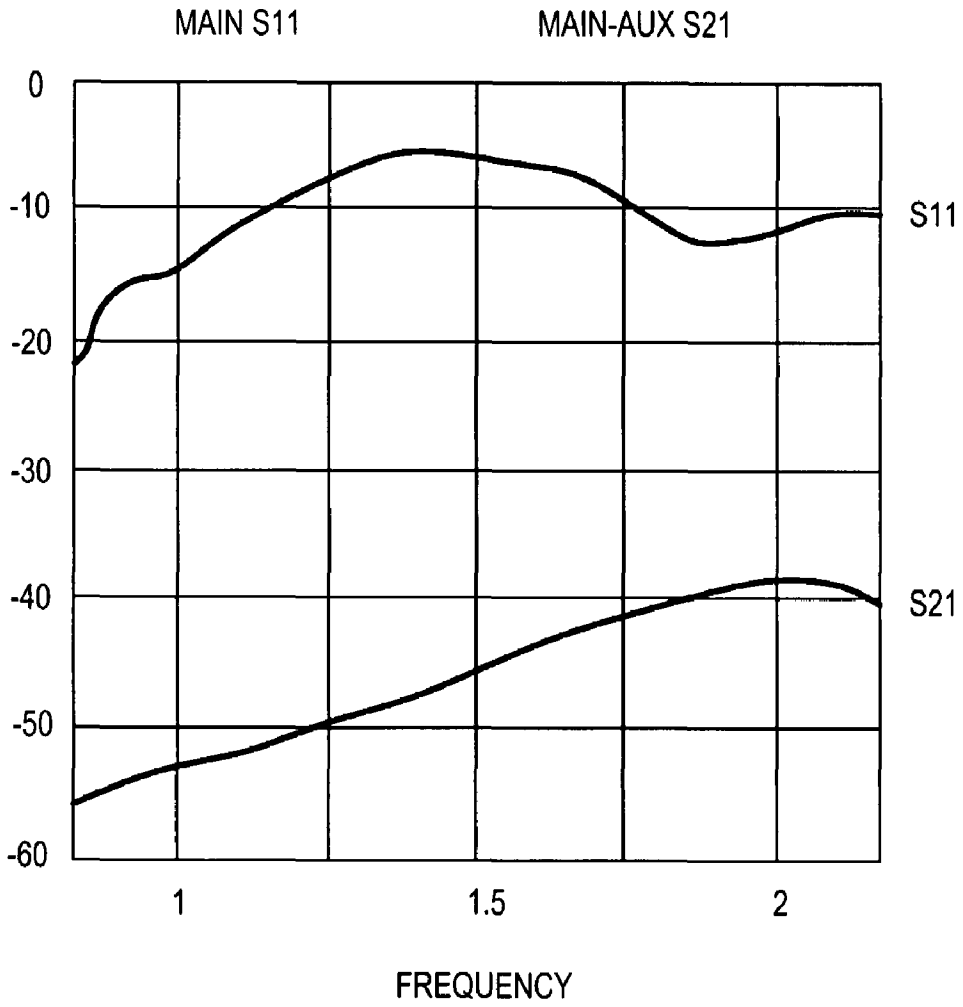
FIG. 11 shows a scalar chart for the antenna system, in accordance with some embodiments of the present invention.

FIG. 11 shows an exemplary scaler chart of the antenna system 100, in accordance with an embodiment of the present invention. The horizontal axis shows the frequency of operation in mega Hertz and the vertical axis shows the power ratio in dB, of the antenna system 100. There are two observations in the chart, first the reflection and second the isolation. Both the reflection and the isolation are power ratio in watt response per watt available. In most broadband antenna applications −6 dB (negative six decibels) of reflected power is taken as upper reflection limit while −10 dB (negative ten decibels) is considered very good. On the other hand, in most narrow spaced antenna diversity reception applications −6 dB (negative six decibels) is taken as upper limit isolation, −10 dB (negative ten decibels) is typical.

In various embodiments of the present invention, the first electromagnetic radiator 102 and the second electromagnetic radiator 104 may have one or more independent radiation paths. The independent radiation paths are provided through different surface-standing-wave-field orientations of the first electromagnetic radiator 102 and the second electromagnetic radiator 104. In an embodiment of the present invention, the first electromagnetic radiator 102 and the second electromagnetic radiator 104 have an orthogonal field orientation. The surface-standing-wave-field orientations may include Electric field orientation, in accordance with an embodiment of the present invention. The surface-standing-wave-field orientations may further include Magnetic field orientation, in accordance with another embodiment of the present invention.

The antenna system 100 is capable of a dual frequency response. The dual frequency response of the antenna system 100 is a result of the establishment of standing waves in the first electromagnetic radiator 102. A surface wave traveling along the first pole 106 and the second pole 108 cannot reach beyond the first end 114 and the second end 122. The surface wave is reflected in a reverse direction, establishing a first standing wave along the first electromagnetic radiator 102. A first optimal electromagnetic radiation may occur when a one-half wave of the first standing wave, with a first pre-determined frequency, fits along the first electromagnetic radiator 102, from the first end 114 to the second end 122. Similarly, a second optimal electromagnetic radiation may take place when a two-half wave of a second standing wave, with a second pre-determined frequency, fits along the first electromagnetic radiator 102.

A suitable impedance at the feed point is required, to permit optimal power transfer in and out of an antenna feed that results in maximum electromagnetic radiation. In the antenna system 100, the off-center series feed 112 permits favorable even harmonics power transfer response at the cost to higher than desired feed impedance. The higher than normal impedance affects are limited to the fundamental frequencies but higher harmonics. The higher than normal impedance comes out at a value up to four times the desired impedance of fifty (50) ohms. Hence, a frequency-selective impedance-matching circuit may be employed to achieve the suitable feed impedance. It will be apparent to one skilled in the art that impedance matching may depend on factors, including the position of the off-center series feed 112.

The depth of the V-notch antenna 200, the U-shaped antenna 206, the slit antenna 210, the gap between the plate 302 and the base plate 304 of the Y-shaped metallic structure 300, and the gap between the first plate 318 and the second plate 320 of the Y-shaped metallic structure 316 corresponds to one-quarter wave of the third predetermined frequency. More specifically, the inside perimeter of the cavity in of the V-notch antenna 200, the U-shaped antenna 206, the slit antenna 210, the Y-shaped metallic structure 300, and the Y-shaped metallic structure 316 corresponds to two-quarter wave of the third predetermined frequency. When referencing to the bottom of the V-notch antenna 200, the U-shaped antenna 206, the slit antenna 210, the Y-shaped metallic structure 300, and the Y-shaped metallic structure 316 cavities, two equal half of cavities may be conceived, each half having their single side perimeters. Each perimeter halves dimensions also corresponds to one-quarter wave of the third predetermined frequency.

The location of shunt feed 120 is referenced to the bottom position of the notch of the second electromagnetic radiator 104. The position of the shunt feed 120 is determined by a specific feed impedance coefficient. The specific feed impedance coefficient is a ratio derived from two numbers; the optimal match feed location and the single side perimeter dimension, both referencing to the bottom position of the notch.

In the foregoing specification, the invention and its benefits and advantages have been described with reference to specific embodiments. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

I claim:

1. An antenna system comprising:

a first electromagnetic radiator incorporating an off-center series feed, wherein the first electromagnetic radiator has a first pole on a first side of the off-center series feed and a second pole on an opposing side of the off-center series feed; and a second electromagnetic radiator incorporating a shunt feed, wherein the second electromagnetic radiator is carved out of, or integrated to the second pole of the first electromagnetic radiator.

2. An antenna system as recited in claim 1, wherein the first electromagnetic radiator comprises a dipole antenna.

3. An antenna system as recited in claim 2, wherein the first pole is shorter than the second pole, and further wherein an electrical size of the sum of the first and second poles correlates closely to two-quarters of a first surface wave-specific wavelength of the antenna system, wherein the first surface wave-specific wavelength is a ratio of a first surface wave speed and a first pre-determined frequency of the antenna system.

4. An antenna system as recited in claim 1, wherein the first electromagnetic radiator is a metallic structure immersed in space, and wherein the second electromagnetic radiator is hollow structure carved out of, or integrated to the parent metal, second pole.

5. An antenna system as recited in claim 4, wherein the second electromagnetic radiator is an antenna selected from a group comprising a V-notch antenna, a U-shaped antenna, a slit antenna, one or more Y-shaped metallic structures, and any symmetric geometry of metal construction on axis (or plane) of symmetry, such that axis (or plane) is concentric to the dipole conductor axis (or plane).

6. An antenna system as recited in claim 5, wherein the first pole is shorter than the second pole, and further wherein a first pole electrical size correlates to one-quarter times a second surface wave specific wavelength of the antenna system, wherein the second surface wave specific wavelength comprises a ratio of a second surface wave speed and a second pre-determined frequency of the antenna system.

7. An antenna system as recited in claim 6, wherein a second pole electrical size loosely correlates to an electrical size of the second electromagnetic radiator, wherein the electrical size of the second electromagnetic radiator correlates to one-quarter times a third surface wave specific wavelength, wherein the third surface wave specific wavelength comprises a ratio of a third surface wave speed and a third pre-defined frequency.

8. An antenna system as recited in claim 1 further comprising:

a first transmission port for the first electromagnetic radiator; and a second transmission port for the second electromagnetic radiator.

9. An antenna system as recited in claim 1, wherein the off-center series feed is at a first pre-defined distance from a first end of the antenna system.

10. An antenna system as recited in claim 9, wherein the first pre-defined distance depends on a frequency of operation of the antenna system.

11. An antenna system as recited in claim 9, wherein the off-center series feed is at a pre-defined position on the first electromagnetic radiator at the first pre-defined distance.

12. An antenna system as recited in claim 9, wherein the off-center series feed is at a pre-defined position at the first pre-defined distance, the pre-defined position being located beyond the edges of the first electromagnetic radiator.

13. An antenna system as recited in claim 1, wherein the second electromagnetic radiator has a feed point at a second pre-defined distance from a second end of the antenna system.

14. An antenna system as recited in claim 13, wherein the second pre-defined distance depends on factors including a frequency of operation and impedance match of the antenna system.

15. An antenna system as recited in claim 1, wherein the first electromagnetic radiator and the second electromagnetic radiator have one or more independent conduction paths.

16. An antenna system as recited in claim 15, wherein the one or more independent conduction paths are provided through one or more transmission lines comprising at least one of a co-axial cable or a micro-strip line.

17. An antenna system as recited in claim 16, wherein the one or more transmission lines are enveloped in a Carbon Fiber braided sleeve of pre-defined length.

18. An antenna system as recited in claim 16, wherein the one or more transmission lines are connected to the first electromagnetic radiator and the second electromagnetic radiator through one or more baluns.

19. An antenna according to claim 16, wherein the one or more transmission lines are connected to the first electromagnetic radiator and the second electromagnetic radiator through a hinged sleeve, wherein the hinged sleeve is capable of rotating at a pre-defined angle.

20. An antenna system as recited in claim 1, wherein the first electromagnetic radiator and the second electromagnetic radiator have one or more independent radiation paths.

21. An antenna system as recited in claim 20, wherein the one or more independent radiation paths are provided through different surface-standing-wave-field orientations between the first electromagnetic radiator and the second electromagnetic radiator.

22. An antenna system as recited in claim 1, wherein the antenna system operates at continuous frequency overtones.

23. An antenna system as recited in claim 22, wherein the continuous frequency overtones comprise a fundamental frequency and a first overtone of fundamental frequency.

24. An antenna system as recited in claim 1 further comprising a means for implementing impedance match.

25. An antenna system as recited in claim 24, wherein the means for implementing impedance match is frequency selective.

* * * * *